US006308382B1

(12) United States Patent
Takahashi et al.

(10) Patent No.: US 6,308,382 B1
(45) Date of Patent: Oct. 30, 2001

(54) LOCKING ASSEMBLY FOR A METAL WATCHBAND

(75) Inventors: Koichiro Takahashi; Kai Cheung Ho, both of Kowloon (HK)

(73) Assignee: Garwin Enterprises Limited (HK)

( * ) Notice: Subject to any disclaimer, the term of this patent is extended or adjusted under 35 U.S.C. 154(b) by 0 days.

(21) Appl. No.: 09/405,563

(22) Filed: Sep. 24, 1999

(30) Foreign Application Priority Data

Jan. 4, 1999 (CN) ..... 99200269

(51) Int. Cl.[7] ..... A44B 11/00; A44C 5/24
(52) U.S. Cl. ..... 24/265 WS; 24/68 J; 24/71 J
(58) Field of Search ..... 24/265 WS, 71 J, 24/70 J, 69 J, 68 J, 583

(56) References Cited

U.S. PATENT DOCUMENTS

| | | | | |
|---|---|---|---|---|
| 2,097,055 | * | 10/1937 | Bender | 24/71 J |
| 2,159,079 | * | 5/1939 | Goulden | 24/71 J |
| 2,185,736 | * | 1/1940 | Prestinari | 24/265 WS |
| 3,665,564 | * | 5/1972 | Oka | 24/265 WS |
| 3,863,299 | | 2/1975 | Hocq | 24/71 J |
| 4,424,611 | | 1/1984 | Mori | 24/192 |
| 5,485,659 | | 1/1996 | Kashikie et al. | 24/71 J |
| 5,689,859 | * | 11/1997 | Cuche | 24/265 WS |
| 5,781,968 | | 7/1998 | Widmer | 24/71 J |
| 5,857,243 | * | 1/1999 | Champion | 24/68 J |

FOREIGN PATENT DOCUMENTS

| | | | | |
|---|---|---|---|---|
| 0157155 | * | 6/1954 | (AU) | 24/71 J |
| 0675056 | * | 8/1990 | (CH) | 24/265 WS |
| 2631173 | * | 1/1977 | (DE) | 24/68 J |
| 2 060 355 | | 5/1981 | (GB) . | |
| 2278148 | * | 11/1994 | (GB) | 24/265 WS |
| 0686720 | * | 3/1965 | (IT) | 24/68 J |

* cited by examiner

*Primary Examiner*—Victor N. Sakran

(57) ABSTRACT

The present invention provides a clasp assembly for a metallic watch chain, mainly comprising: an inner bend plate, an outer bend plate, and a clasp cap. Said inner bend plate can fit into the narrow groove of the outer bend plate. A convex clasp is disposed on the inner bend plate and corresponds to a concave clasp disposed on the outer bend plate in shape, position and size, and the two clasps engage with each other. The lock and release of the convex and concave clasps causes the lock and release of the watch chain. The clasp cap pivotably connects with the inner bend plate through screws. The hole of the clasp cap connects with the watch chain, and the outer bend plate connects with the watch chain through the cylindrical bodies at the left end. The structure of the clasp assembly is simple and is easy to use.

12 Claims, 8 Drawing Sheets

(a)

(b)

LOCKING ASSEMBLY FOR A METAL WATCHBAND

FIELD OF THE INVENTION

The subject invention relates to a watch chain, particularly to metallic watch chain clasp assembly.

DESCRIPTION OF THE PRIOR ART

Conventionally, the structure of the clasp for a metallic watch chain is very complicated, involves a lot of parts, and is difficult to assemble and maintain. Therefore, there is a need to develop a metallic watch chain clasp assembly which has a simple structure, involves fewer components, and which is easy to produce and assemble, as well as easy to handle.

SUMMARY OF THE INVENTION

The object of the subject invention is to provide a clasp assembly for a metallic watch chain, which has a simple structure, involves fewer components, and which is easy to produce and assemble, as well as easy to handle.

To achieve the above object, the present invention provides a clasp assembly for a metallic watch chain, comprising: an inner bend plate, an outer bend plate, a clasp cap, screws and a shaft. Said inner bend plate can fit into the narrow groove of the outer bend plate. A convex clasp disposed on the inner bend plate corresponds and fits with a concave clasp disposed on the outer bend plate in shape, position and size, and the two clasps engage with each other. The lock and release of the convex and concave clasps cause the lock and release of the watch chain.

The advantages of the clasp assembly of the present invention lies in the simplicity of the structure. It consists of fewer components, and the structure of the components is simple, therefore, it is easy to manufacture and assemble, as well as easy to use.

BRIEF DESCRIPTION OF THE DRAWINGS

The present invention will be better understood and its various objects and advantages will be more fully appreciated from the following detailed description in conjunction with the accompanying drawings, which are only for the purposes of reference and description and shall not be based to restrict or limit the subject invention, in which.

DETAILED DESCRIPTION OF THE PREFERRED EMBODIMENT

Figure 1:
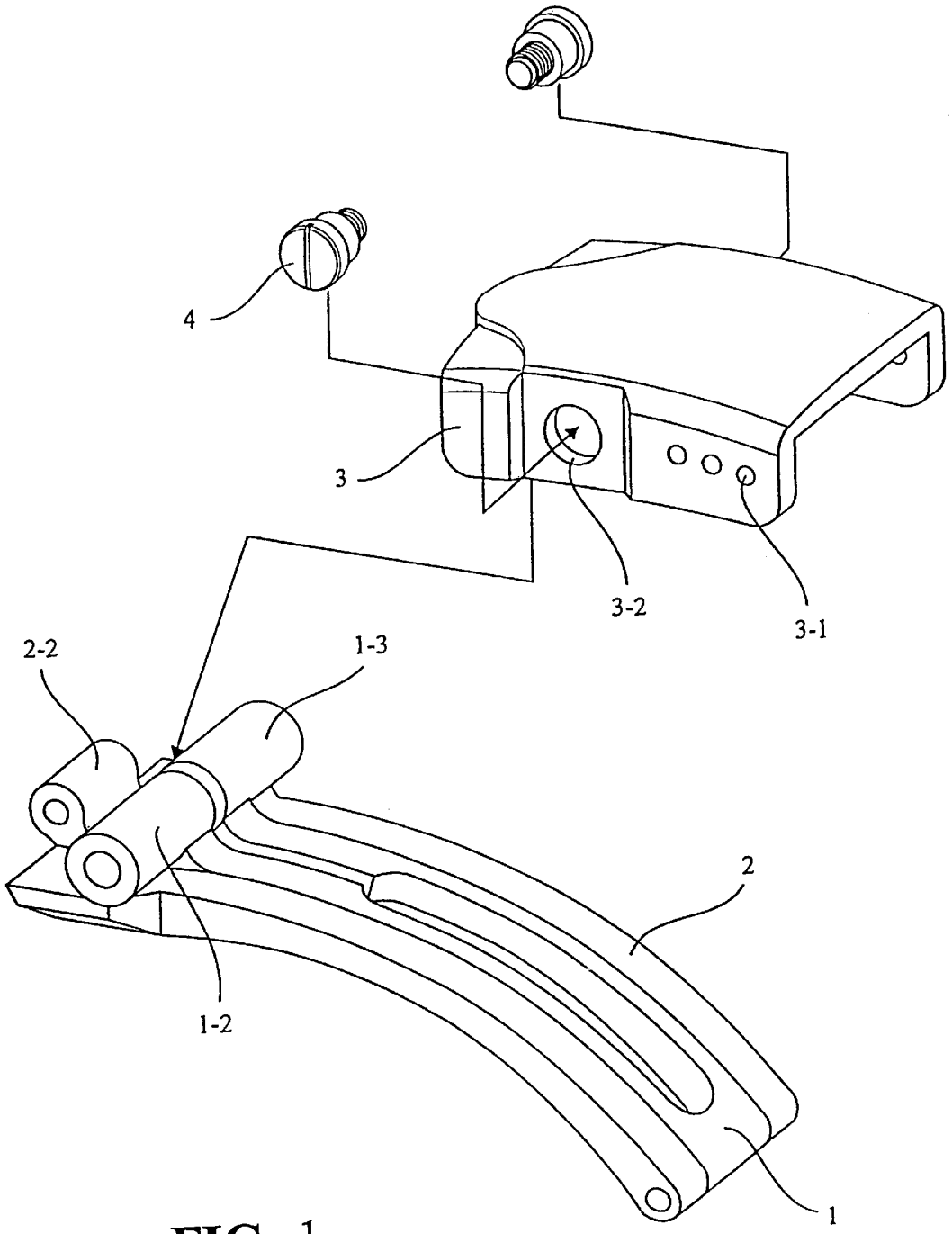
FIG. 1 is an exploded perspective view of the clasp assembly for a watch chain according to the an embodiment of the subject invention.

Referring to the FIG. 1 which shows an embodiment of a clasp assembly for a metallic watch chain according to the invention, the clasp mainly includes an inner bend plate 1, an outer bend plate 2, a clasp cap 3 and screws 4. Inner bend plate 1 comprises two legs, which are fixed with cylindrical bodies 1-2 and 1-3 respectively. The inner bend plate 1 fits into the outer bend plate 2, a convex clasp and a concave clasp therein engage with each other so that the inner bend plate and the outer bend plate are combined into one bend plate. The clasp cap 3 movably connects with the inner bend plate 1, i.e. the through holes 3-2 on the both sides of the clasp cap 3 align with the holes in the cylindrical bodies 1-2 and 1-3 on the inner bend plate 1, then the screws 4 are driven into the aligned holes. The clasp 3 can pivot a little about the screws 4. The assembling of the clasp assembly for a watch chain is thus finished. It is connected to the watch and the chain through the hole 3-1 in the clasp cap 3 and the hole in the cylindrical body 2-2 on the ooter bend plate 2.

The clasp assembly for a metallic watch chain of the embodiment shown in FIG. 1 involves fewer components. The inner bend plate and the outer bend plate are difficult to manufacture and will be explained in detail later.

Figure 2:
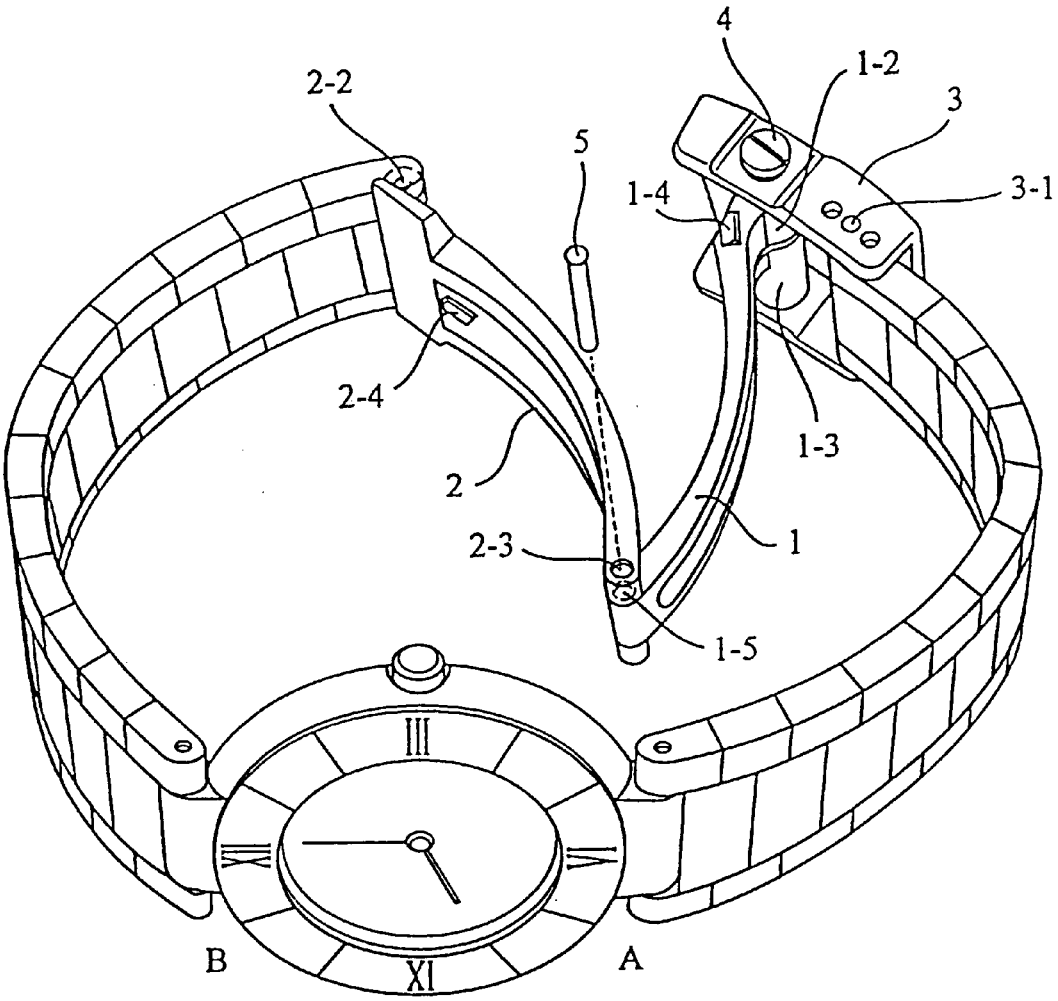
FIG. 2 is a perspective view of a watch including the clasp assembly of FIG. 1 in a completely connected state.

FIG. 2 illustrates the watch chain according to the present invention connected on the watch which is used to show that it is easy to use. The shaft 5 passes through the hole 2-3 in the outer bend plate 2 and the hole 1-5 in the inner bend plate 1 to connect the outer and inner plate together. The shaft 5 engages tightly with the hole 2-3 of the outer bend plate 2 by means of riveting. The shaft 5 slidably engages with the hole 1-5 such that the inner bend plate can readily pivot about the shaft 5 so as to enlarge or reduce the watch's caliber to let the hand pass through and clamp the watch chain around the wrist When the inner and outer bend plates 1 and 2 are connected with each other with the shaft 5 as a pivoting axle, the convex clasp 1-4 disposed on the distal end of the inner plate 1 relative to the shaft clamps with the concave clasp 2-4 correspondingly disposed on the outer bend plate 2 so that the clasp assembly of the watch chain is locked. When putting on the watch, one should engage the convex clasp 1-4 with the concave clasp 2-4 so that the watch can stay well on the wrist. When the force to release the engagement between the convex clasp 1-4 and the concave clasp 2-4 is applied, then the clasp assembly opens, and the watch can be removed from the wrist. The screws 4 pass through the cylindrical bodies 1-2 and 1-3 on the distal end of the inner bend plate 1 relative to the shaft so that the clasp cap 3 can pivot about the screws 4. The clasp cap 3 connects with one section of the watch chain through the hole 3-1 therein, which section connects with the end A of the watch. The other section of the watch chain connects with the end B of the watch at one end, and pivotably connects with central hole in the cylindrical body 2-2 on the outer bend plate 2 at the other end thereof.

FIG. 2 shows the structure and connection relationship of the clasp assembly for the watch chain according to the present invention which shows the technical features of the clasp assembly, and especially shows that the locking and releasing of the clasp assembly are realized by means of the clamping and releasing of the convex clasp 1-4 and the concave clasp 2-4, and the inner bend plate 1 is disposed in such a manner that it fits into the middle of the outer bend plate 2.

Figure 3:
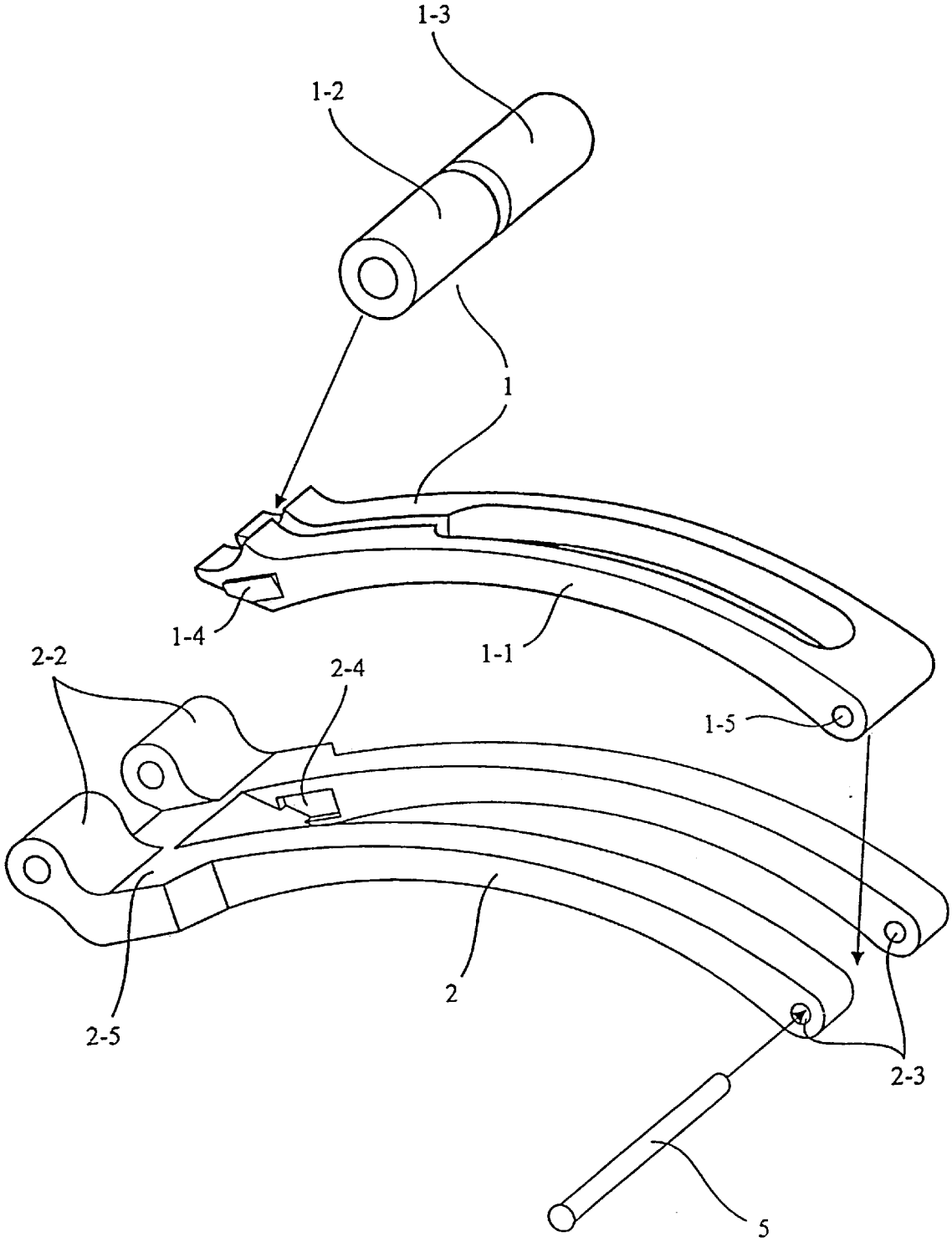
FIG. 3 is an exploded perspective view of the bend plate of the clasp assembly for a watch chain according to the invention.

FIG. 3 shows an exploded perspective view of the inner bend plate 1 and the cylindrical bodies 1-2 and 1-3 thereon, the outer bend plate 2 and the shaft 5. The figure clearly shows that the inner bend plate 1 includes three small parts, i.e. a plate body 1-1 and cylindrical bodies 1-2 and 1-3, which are produced separately and then are welded to form a single component. The outer bend plate 2 is a single component, and the shaft 5 is a single component. The shaft 5 successively passes through the holes 2-3, 1-5 and 2-3, in which the hole 1-5 is a through hole in the plate body 1-1 of the inner bend plate 1, and holes 2-3 are two through holes in the outer bend plate 2 engaging with the shaft 5, so that the shaft 5 is firmly supported from the two ends. The outer bend plate 2 is an arcuate bend plate of a certain thickness. The outer bend plate 2 has a holding groove whose width is bigger than that of the plate body 1-1 of the inner bend plate so that the plate body 1-1 of the inner bend plate 1 can rotate freely in the holding groove. The shape, bending degree, and thickness of the inner and outer bend plates 1 and 2 are corresponding or identical. The position of the inner bend plate 1 relative to the outer bend plate 2 is determined by the two convex clasps 1-4 disposed on the both sides of the inner bend plate 1 and the two concave clasps 2-4 disposed on the both sides of the outer bend plate 2. When the convex clasp 1-4 and the concave clasp 2-4 are engaged, the inner bend plate 1 and the outer bend plate 2 they form a bend plate which looks like a single component. The cylindrical bodies 1-2 and 1-3 of the inner bend plate 1 lie against the surface of the flange 2-5 of the outer bend plate 2 to form a visually appealing appearance.

Unlike the assembly in the FIGS. 1 and 2, the cylindrical body 2-2 on the distal end of the outer bend plate 2 relative to the hole 2-3 is divided into two sections, but they have the same function as the cylindrical body 2-2 in the FIGS. 1 and 2.

Figure 4:
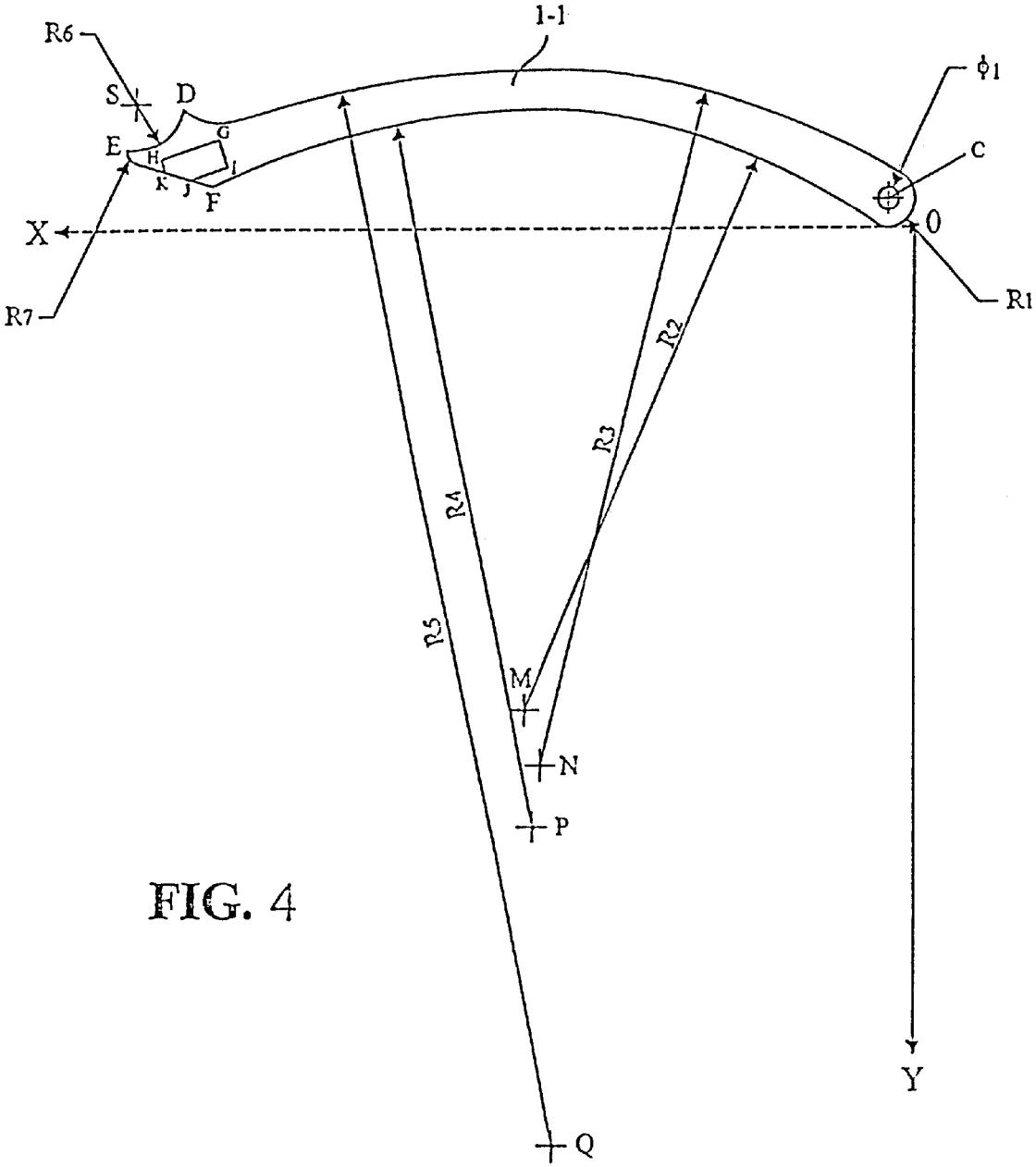
FIG. 4 is a structural view of the plate body of the inner bend plate of the clasp assembly for a watch chain according to the invention.

FIG. 4 shows the plate body structure of the inner bend plate 1 of the clasp assembly according to one embodiment of the present invention. For convenient explanation, a coordinate surface x-o-y is established, in which the horizontal leftward direction is the positive direction of the x-axis, and vertically downward direction is the positive direction of the y-axis. The x-axis and the y-axis cross at the point o which is the origin of the coordinate system. The plate body 1-1 in the figure is mainly an arcuate shape, in which the hole 1-5 on the right end has the central point C, the arc with radius $R_1$ is tangential to the x-axis and y-axis. The right part of the upper arc of the plate body 1-1 has radius $R_3$ whose center is N, and the left part thereof has radius $R_5$ whose center is Q. The right part of the lower arc of the plate body 1-1 has radius $R_2$ whose center is M, and the left part thereof has radius $R_4$ whose center is P. There are three sharp angles at the left end of the plate body 1-1, i.e. points D, E, and F respectively. DE is an arc shape whose radius is $R_6$ and whose center is S. The convex clasp 1-4 is the pentagon consisted of HGIJK. There is a chamfering arc with a radius $R_7$ at the E point transiting a little toward the point F. The through hole at the right end has a radius $\phi_1$, which has been illustrated in detail.

Figure 5:
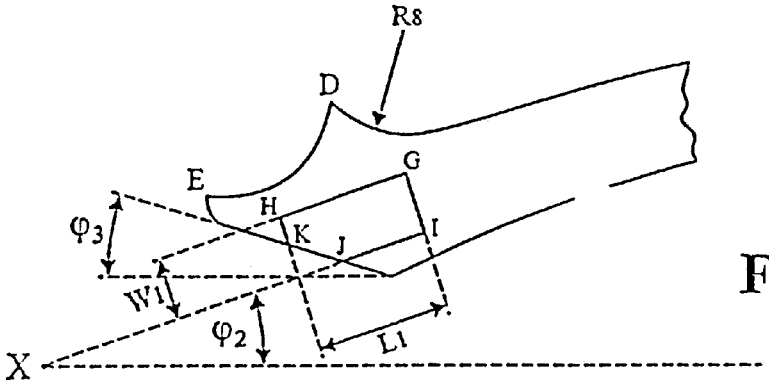
FIG. 5 is a partially enlarged view of the plate body of the inner bend plate of the clasp assembly for a watch chain according to the invention.

FIG. 5 is the enlarged view of the left end of the plate body 1-1 shown in the FIG. 4 so as to clearly illustrate shape and the size of the convex clasp 1-4, which shows that the pentagon HGIJK is a rectangle with an corner cut away. HG is parallel to IJ, GI is parallel to HK, and the line IJ has an angle $\Phi_2$ relative to the x-axis, the line JK has an angle $\Phi_3$ relative to the x-axis. The line segment HG has a length of $L_1$, the line segment GI has a length of $W_1$, which constitute the length and width of the rectangle. The distal side at the point D relative to the point E has a transiting arc whose radius is $R_8$.

Figure 6:
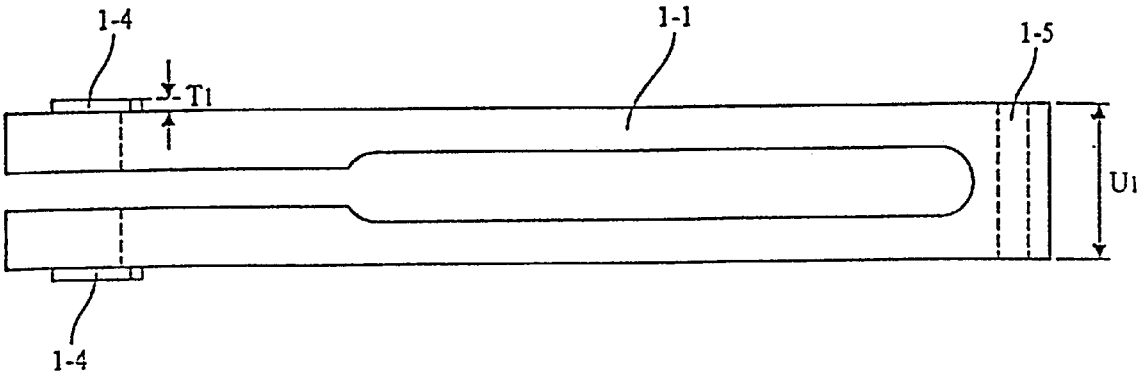
FIG. 6 is a plan view of the plate body of the inner bend plate of the clasp assembly for a watch chain according to the invention.

FIG. 6 is a plan view of the plate body 1-1 shown in the FIG. 4. It could be seen from the FIG. 6 in conjunction with the FIG. 4 that the plate body shown is an arcuate strip with uniform width, in the middle of which there is a narrow groove which is open at the left end and which is narrow at the left side and wider at the middle thereof. The width of the plate body 1-1 is $U_1$, and the dotted lines on the right of the figure represent the through hole 1-5. On the left of the figure there are outward protrusions, i.e. the convex clasps 1-4 whose protruding height is $T_1$.

The plate body 1-1 shown in the FIG. 6 is substantially a U-shaped with the opening towards the left. The figure clearly shows that there are two convex clasps 1-4 equally protruding outwards whose protruding height are $T_1$.

Figure 7:
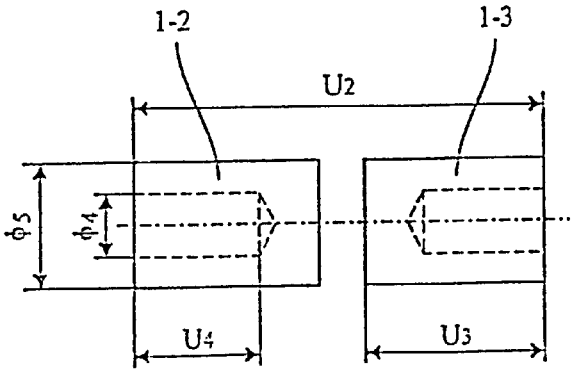
FIG. 7 is a structural view of the cylindrical body of the inner bend plate of the clasp assembly for a watch chain according to the invention.

FIG. 7 shows the cylindrical bodies 1-2 and 1-3 on the inner bend plate 1 according to one embodiment of the present invention. The cylindrical bodies 1-2 and 1-3 have the same shape and size, whose outer diameter is $\phi_5$ and whose length is $U_3$. The blind hole has a diameter of $\phi_4$ and a depth of $U_4$. During assembly, the holes of the two cylindrical bodies open outward, and the two opening surfaces are apart from each other by $U_2$. The cylindrical bodies are disposed on the arc DE shown in the FIGS. 4 and 5. Therefore, the diameter $2R_6$ of the arc equals the diameter $\phi_5$ of the cylindrical bodies 1-2 and 1-3 shown in the FIG. 7. The above explanation discloses the configuration and feature of the components of the inner bend plate 1.

Figure 8:
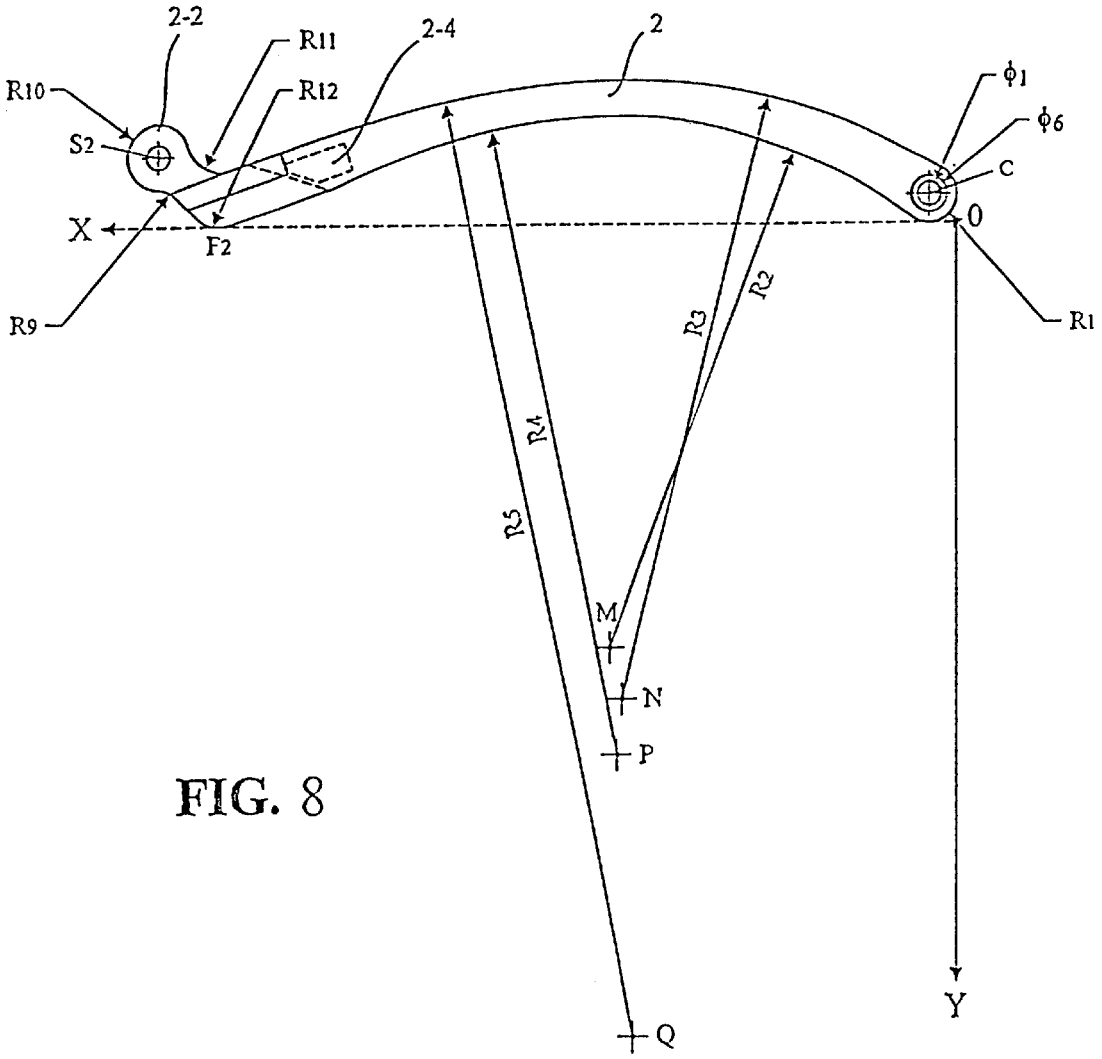
FIG. 8 is a front view of the outer bend plate of the clasp assembly for a watch chain according to the invention.

FIG. 8 is a front view of the outer bend plate 2 according to an embodiment of the present invention. Like FIG. 4, a coordinate system x-o-y is established, and parts having the same arc, same position and same size with those in the FIG. 4 use the same reference symbols. In fact, the middle and right portions of the outer bend plate 2 in the FIG. 8 have the same shape and size with those of the inner bend plate 1 shown in the FIG. 4. That is, the center of the through hole 2-3 at the right end thereof is at is the point C whose diameter is $\phi_1$ and whose outer circle has a radius of $R_1$, and is tangential to the x and y axis. The radii of the upper and lower arcs are $R_3$, $R_5$, $R_2$, $R_4$, and the centers thereof are N, Q, M, P respectively. The left end of the outer bend plate 2 is different in shape. The lower arc changes into a downward straight line at the position about two fifths of its length near the concave clasp 2-4, and it transits near the x-axis through an arc with a radius $R_{12}$ and then rises toward the left side, and is tangential to the x-axis at the point $F_2$. The rising portion connects with the outer arc of the cylindrical body 2-2 at the left end whose center is $S_2$ and whose radius is $R_{10}$ through a transitting arc whose radius is $R_9$. The outer arc connects through a transitting arc whose radius is $R_{11}$ with extension line of the tangent of the arc whose radius is $R_5$ on the upper arc. The FIG. 8 shows the shape and structure of the outer bend plate 2 in detail.

Figure 9:
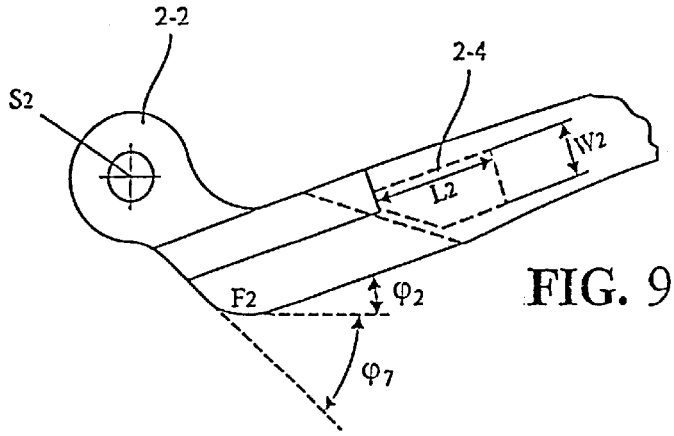
FIG. 9 is a partially enlarged view of the outer bend plate of the clasp assembly for a watch chain according to the invention.

FIG. 9 illustrates the shape and structure of the rising portion and the concave clasp 2-4 shown at the left side of the FIG. 8. The rising angle from the point $F_2$ toward the upper and outside direction is $\Phi_7$. The position of the rectangle of the concave clasp 2-4 corresponding to the convex clasp 1-4 still has the angle $\Phi_2$ relative to the x-axis. The length $L_2$ and the width $W_2$ in the FIG. 9 are a little longer than the length $L_1$ and the width $W_1$ of the convex clasp 1-4 on the plate body 1-1 of the FIG. 5 so as to receive the convex clasp 1-4 and engage tightly with the convex clasp 1-4. The sizes of other unengagement parts can be selected by a designer according to the FIG. 9.

Figure 10:
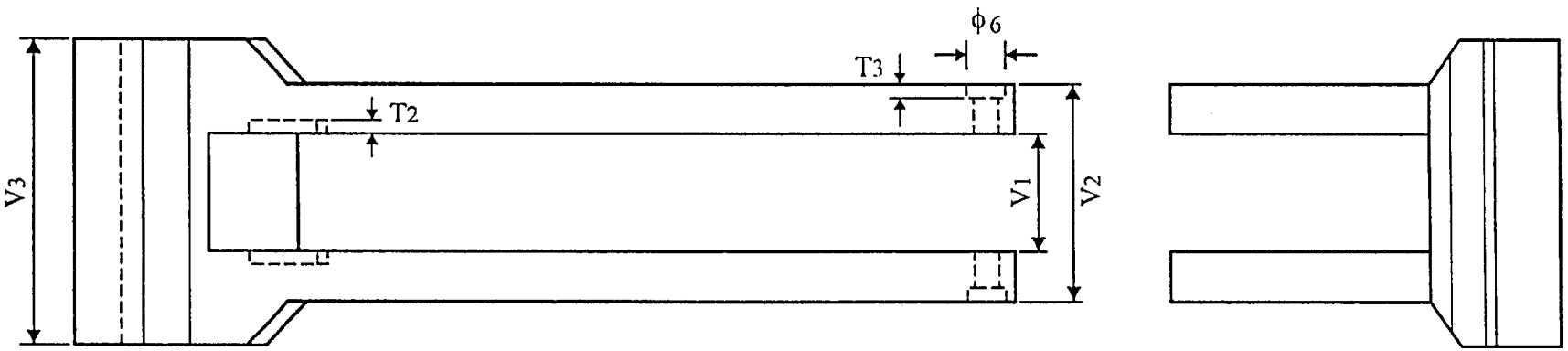
FIGS. 10A and 10B are a plan view and a side view of the outer bend plate of the clasp assembly for a watch chain according to the invention.

FIGS. 10A and 10B are a plan view of the outer bend plate 2 shown in the FIG. 8 and a right view corresponding to the plan view. The shape and size of the outer bend plate 2 can be clearly illustrated in conjunction with the drawings. From the drawings we can see that the outer bend plate 2 is generally an arcuate shape with equal width of $V_2$, in the middle of which is a narrow groove opening at the right end. The width of the narrow groove is $V_1$ which is a little larger than the width $U_1$ of the plate body 1-1 so as to fit the plate body 1-1 into the narrow groove. An outward protrusion is disposed on the left end of the outer bend plate whose total width is $V_3$ which is equal and correspond to the $U_2$ of FIG. 7. The FIG. 10A shows that the concave clasp 2-4 recedes outwards from the narrow groove uniformly and the recessed dimension is $T_2$ which is a little larger than $T_1$ so as to receive the convex clasp 1-4. The through holes at the right end of the outer bend plate shown in the FIG. 10A have flanges whose diameters are $\phi_6$ on the upper and lower outside surfaces in order to rivet the shaft 5 in place.

Figure 11:
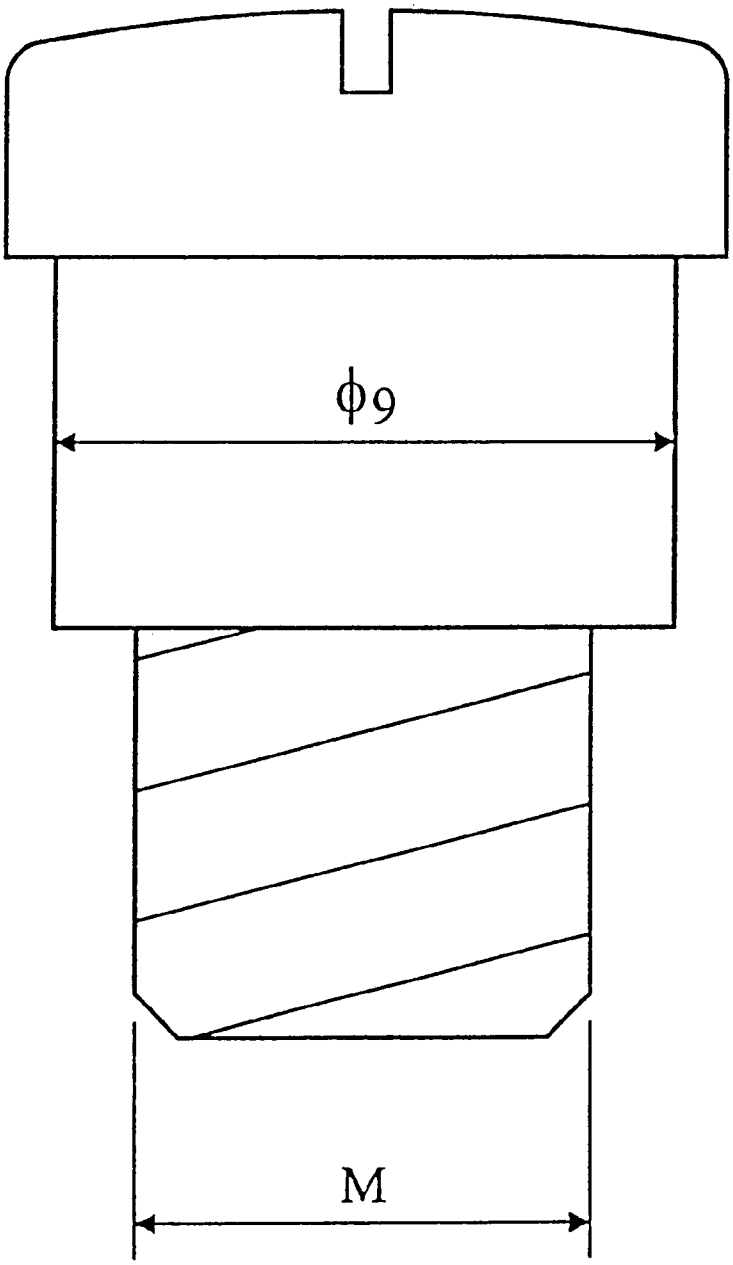
FIG. 11 is a structural diagram of the screw of the clasp assembly for a watch chain according to the invention.

FIG. 11 shows the structure of the screw 4 according to an embodiment of the present invention. The screw 4 has a straight groove on the outside end so that it can be driven in with a screwdriver. The lower end of the screw 4 has thread designated with M above which there is a cylinder portion whose diameter is $\phi_9$. The thread portion is driven into the blind holes in the cylindrical bodies 1-2 and 1-3 shown in the FIG. 7. The dimension of $\phi_4$ corresponds to the nominal dimension of the thread M. The cylindrical portion of the screw 4 whose diameter is $\phi_9$ corresponds to the diameter of the through hole 3-2 of the clasp cap 3. With the screw 4 screwed in, the clasp cap 3 can rotate freely.

Below are the main dimensions of one embodiment (unit:mm): the coordinate of the point M is (16.6908, 19.9300), the coordinate of the point N is (16.0455, 22.3043), R2=25.00, R3=29.00, the coordinate of the point F is (29.9414, −1.7508), the coordinate of the point S is (33.1545, −5.2981), the coordinate of the point C is (1.20, −1.20), $\phi_1$=1.00, $R_1$=1.20, $R_6$=2.00, $\Phi_2$=19°, $\Phi_3$=17°, $L_1$=2.60, $W_1$=1.20, $T_1$=0.40, $U_1$=4.95, $\phi_4$=2.00, $\Phi_5$=4.00, $U_2$=13.00, $U_3$=5.90, the coordinate of the point $F_2$ is (35.7369, 0), the coordinate of the point $S_2$ is (38.2318, −3.5684), $R_{10}$=1.50, $\Phi_7$=46°, $L_2$=3.00, $W_2$=1.40, $T_2$=0.60, $\phi_6$=1.60, $V_2$=9.40, $V_3$13.00, $\phi_9$=3.00, the thread M=2.00.

There can be many embodiments with different sizes and similar shapes and all of the embodiments which have similar structures to that of the present invention fall into the protection scope of the present invention.

The clasp assembly for the watch chain according to the present invention has a simply structure, and is easy to use. The development of the present invention adds a new type to the metallic watch chain and provides a good selection for people wearing the watch.

What is claimed is:

1. A clasp assembly for a metallic watch chain comprising:

an inner bend plate having plate body and a convex clasp;

an outer bend plate pivotally coupled to the inner bend plate about a shaft, the outer bend plate having a groove formed therein for receiving the inner bend plate, the outer bend plate further including a concave clasp which is formed on a side of the outer bend plate, the concave clasp matingly engaging with the convex clasp of the inner bend plate to lock the watch chain; and a clasp cap movably connected to the inner bend plate by at least one screw.

2. The clasp assembly for a watch chain as claimed in claim 1, characterized in that said convex clasp (1-4) and s aid concave clasp (2-4) as disposed on the distal ends relative to the hole engaging with the shaft (5).

3. The clasp assembly for a watch chain as claimed in claim 1, characterized in that the convex clasp (1-4) is of a rectangular shape with a corner cut away.

4. The clasp assembly for a watch chain as claimed in claim 1, characterized in that the protrusion height of the convex clasp (1-4) is 0.40 mm, the corresponding recessive depth of the concave clasp (2-4) is 0.6 mm.

5. The clasp assembly for a watch chain as claimed in claim 1, characterized in that the length of the convex clasp (1-4) is 2.60 mm, the width of the convex clasp (1-4) is 1.20 mm, and the length and width of the concave clasp (2-4) are 3.00 mm and 1.40 mm correspondingly.

6. The clasp assembly for a watch chain as claimed in claim 1, characterized in that the arcuate sections of the inner bend plate (1) and the outer bend plate (2) are the same in shape and size.

7. The clasp assembly for a watch chain as claimed in claim 1, characterized in that the shape and size of the inner bend plate (1) and the outer bend plate (2) are determined by the coordinates of the points (C, M, N, P, Q) and the radii ($R_1$, $R_2$, $R_3$, $R_4$, $R_5$).

8. The clasp assembly for a watch chain as claimed in claim 7, wherein the coordinates and the dimensions used to determine the shape of the arcuate sections of the inner and outer bend plates can be: the coordinate of the point (C) (1.20, −1.20), the coordinate of the point (M) (16.6908, 19.9300), the coordinate of the point (N) (16.0455, 22.3043), $R_2$=25.00, $R_3$=29.00.

9. The clasp assembly for a watch chain as claimed in claim 1, characterized in that the inner bend plate (1) movably connects with the outer bend plate (2) through the shaft (5).

10. The clasp assembly for a watch chain as claimed in claim 1, characterized in that the inner bend plate (1) movably connects with the clasp cap (3) through the screws (4).

11. The clasp assembly for a watch chain as claimed in claim 1, characterized in that the width of the narrow groove of the outer bend plate (2) is larger than that of the plate body (1-1) of the inner bend plate (1).

12. The clasp assembly for a watch chain as claimed in claim 1, characterized in that the angle $\Phi_2$ between the straight line HG and the x axis is 19°.

* * * * *